US008011930B2

(12) United States Patent
Lee et al.

(10) Patent No.: US 8,011,930 B2
(45) Date of Patent: Sep. 6, 2011

(54) ELECTRICAL POWER RECEPTACLE WITH ROTATABLE USB JACKS

(75) Inventors: Yu-Lung Lee, Miaoli County (TW); Jung-Hui Hsu, Taipei County (TW); Ming-Chou Kuo, Taipei (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 12/724,638

(22) Filed: Mar. 16, 2010

(65) Prior Publication Data

US 2011/0159704 A1 Jun. 30, 2011

(30) Foreign Application Priority Data

Dec. 31, 2009 (TW) ..... 98146189 A

(51) Int. Cl.
*H01R 39/00* (2006.01)

(52) U.S. Cl. ..... 439/18; 439/638

(58) Field of Classification Search ..... 439/11, 439/13, 18, 20–28, 107, 188, 638
See application file for complete search history.

(56) References Cited

U.S. PATENT DOCUMENTS

| | | | | |
|---|---|---|---|---|
| 5,775,921 | A | 7/1998 | Chou | |
| 5,954,519 | A * | 9/1999 | Hsiao | 439/21 |
| 5,997,310 | A | 12/1999 | Chiu et al. | |
| 6,004,138 | A | 12/1999 | Harbertson | |
| 6,015,307 | A | 1/2000 | Chiu et al. | |

* cited by examiner

*Primary Examiner* — Khiem Nguyen
(74) *Attorney, Agent, or Firm* — Rosenberg Klein & Lee

(57) ABSTRACT

Disclosed is an electrical power receptacle with rotatable USB jacks comprising a main body including at least one shaft section; at least one electrical outlet assembly being disposed on the main body; a rotating member, coupled to the main body via the shaft section, being rotatable along the shaft section, and a rotational angle thereof being determined with respect to structural designs; and at least one USB jack assembly, being disposed on the rotating member and rotatable along with the rotational movement of the rotating member. An electric plug assembly with conducting prongs is disposed on the main body for connecting with the public electrical power distribution system. Thus, by adjusting the direction of rotation in accordance with the USB jack assemblies according to the present invention, the restriction in application range thereof decreases.

10 Claims, 6 Drawing Sheets

ELECTRICAL POWER RECEPTACLE WITH ROTATABLE USB JACKS

BACKGROUND OF THE INVENTION

1. Field of the Invention

The present invention relates to an electrical power receptacle, in particular, to an electrical power receptacle with rotatable USB jacks.

2. Description of Related Art

With the present continuous development of modern society, more and more electronic devices are utilized in public. To operate the electronic devices, electrical power supplies are required to drive the electronic devices. Generally specking, peripheral electronic devices are usually designed as portable electronic devices. Because the main design factors for portable electronic devices emphasize on how to reduce an overall dimensional size or overall weight, it is not suitable to connect with the public electrical power distribution system for electrical power directly. Consequently, a conventional method for supplying electrical power to the conventional peripheral electronic devices is to utilize USB connectors which are capable of connecting to USB jacks of main electronic apparatuses electrically.

Yet, the above-mentioned USB connection for the portable electronic devices is an indirect connection by connecting to the USB jacks designed on the main electronic apparatuses for achieving the intended objectives of connecting the portable electronic devices electrically. Thus, the limitations of the USB interface connection, no only increase the burden for manufactures to redesign circuitry for the main electronic apparatuses with regards to the USB connection, but also increase the limitations in use. Because the old design for electronic apparatuses does not have USB jacks, these old apparatuses are not compatible with the present peripheral electronic devices by applying USB connectors.

Meanwhile, in response to the present requirements with the vigorous development of portable electronic devices, electronic device design is tended towards increasing portability for ease and convenience of movement. However, the conventional USB jacks are usually firmly installed on the peripheral area of the electronic apparatuses. Thus, as long as the USB connectors of the portable electronic devices connect to the aforementioned fixed USB jacks, the movement range of the portable electronic devices is restricted by the USB connection direction, the convenience of mobility is also reduced, and the USB connectors applied for portable electronic devices are vulnerable to be damaged due to improper operations, thereby reducing the service life thereof.

SUMMARY OF THE INVENTION

As per the aforementioned issues, a primary objective of the present invention is to provide an electrical power receptacle with rotatable USB Jacks in accordance with the structural design thereof for solving the restrictions in USB connection directions with regards to the conventional fixed type USB jacks. Furthermore, the design of USB jack assembly according to the present invention provides a simplified and direct electrical connection interface for a variety of electronic devices adapted for the USB interface connection. Moreover, the electrical power receptacle with rotatable USB jacks according to the present invention simplifies the structure design, thereby decreasing the overall manufacturing cost.

To solve the aforementioned issues, disclosed is an embodiment of an electrical power receptacle with rotatable USB jacks according to the present invention, comprising a main body, at least an electrical outlet assembly, a rotating member, and at least a USB jack assembly. Herein, the main body includes at least a shaft section; at least one electrical outlet assembly is disposed on the main body; the rotating member is mating engagement with the shaft section and is capable of rotating with respect to a predetermined axis of the shaft sections in any angle in accordance with the structural design thereof; and at least one USB jack assembly is disposed on the rotating member, such that as the rotating member rotates, substantially, the USB jack assembly rotates as well.

As per the aforementioned electrical power receptacle with rotatable USB jacks according to the present invention, the USB jack assembly with a simplified design and low manufacturing cost may electrically connect to USB connectors of the electronic devices directly, instead of indirectly connecting to an intermediate electronic apparatus first, thereby increasing the power efficiency and convenience of use. Moreover, the rotating member of the electrical power receptacle with rotatable USB jacks is capable of adjusting the direction of the USB jack assembly with respect to various application environments and situations. In other words, the rotating member can change the rotational directions so as to reduce the restrictions in application range and prevent from damaging the USB connector, so that the service life of the USB connector will not be shortened due to improper operations in practice.

In order to further understand the techniques, means and effects the present invention takes for achieving the prescribed objectives, the following detailed description and included drawings are hereby referred, such that, through which, the purposes, features and aspects of the present invention can be thoroughly and concretely appreciated; however, the included drawings are provided solely for reference and illustration, without any intention to be used for limiting the present invention, whose full scope and dimension is described only in the later following claims.

DETAILED DESCRIPTION OF THE PREFERRED EMBODIMENTS

An electrical power receptacle with rotatable USB jacks according to the present invention is provided. As per the structural design perspective view, the USB jack assemblies are not only utilized for enhancing the convenience in charging and supplying electrical power to the portable electronic devices, but also utilized for reducing the restrictions of use in space in accordance with changing the rotational directions thereof.

Figure 1:
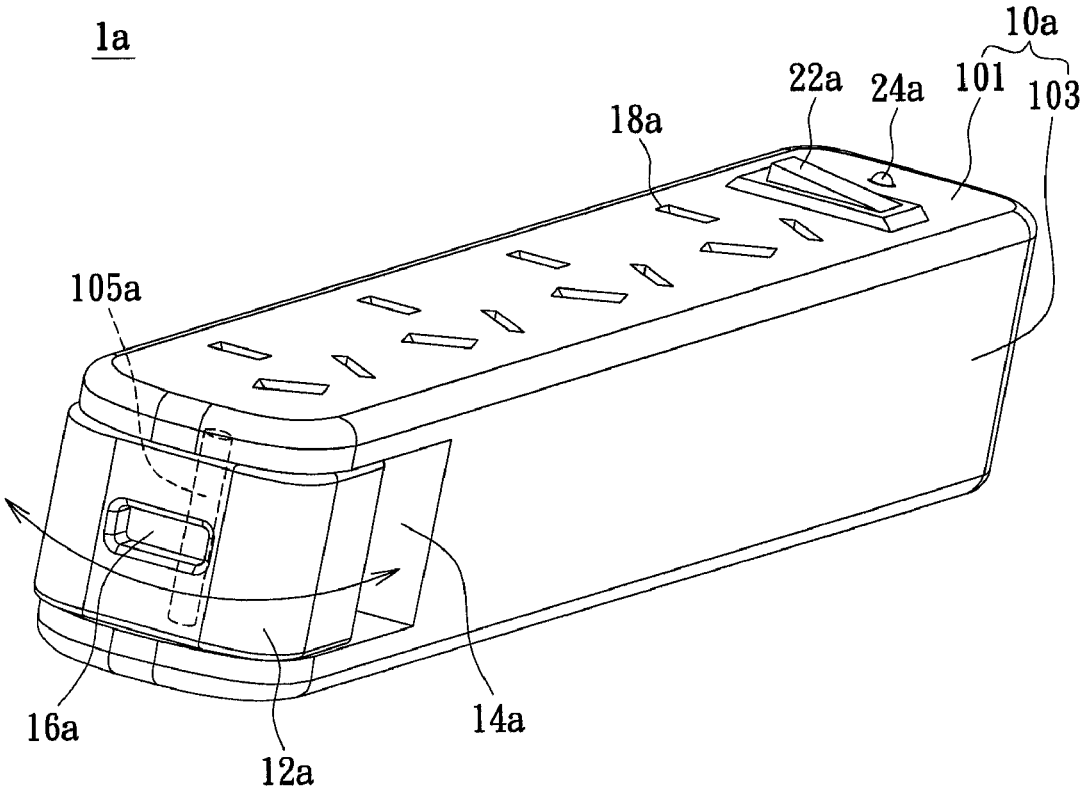
FIG. 1 illustrates an exploded diagram of a first embodiment of the electrical power receptacle with rotatable USB jacks according to the present invention.

First please refer to FIG. 1, in which an exploded diagram of a first embodiment of the electrical power receptacle with rotatable USB jacks in accordance with certain aspects of the present technique is demonstrated. An electrical power receptacle with rotatable USB jacks 1*a* comprises a main body 10*a*, at least an electrical outlet assembly 18*a*, a rotating member 12*a*, and at least a USB jack assembly 16*a*. Herein, the main body 10*a* further includes a first housing member 101, a second housing member 103, and a shaft section 105*a*. The electrical power receptacle with rotatable USB jacks 1*a* further includes an accommodating section 14*a*, a power switch 22*a*, and an indicator 24*a*.

The main body 10*a* is constructed by the first housing member 101 and the second housing member 103. The electrical outlet assemblies 18*a* are disposed on the main body, which allow the electronic devices to connect to the electrical outlet assemblies 18*a* for receiving the public electrical power. In the embodiment, the shaft sections 105*a* are disposed on the peripheral portions of the main body 10*a*. The rotating member 12*a* couples to the main body 10*a* thru mating engagement with the shaft section 105*a*, so that the rotating member 12*a* may rotate with respect to a predetermined axis of the shaft section 105*a* transversely and the rotatable angle thereof is determined by the structural design of the main body 10*a*. As shown in the FIG. 1, the accommodating section 14*a* in accordance with the shaft section 105*a* is disposed on the peripheral portion of the main body 10*a*. The shaft section 105*a* is disposed inside the accommodating section 14*a* in conjunction with the operations of the rotating member 12*a* so as to permit the maximum rotatable angle of the rotating member 12*a* to be around 180 degrees. The at least one USB jack assembly 16*a* is disposed on the rotating member 12*a*, so that the USB jack assembly 16*a* may utilize the rotating member 12*a* to achieve the intended objectives of rotating and changing directions of the USB jack assembly 16*a*. The electrical outlet assemblies 18*a* may be either one or a combination of three-slot or two-slot electrical outlets. In the embodiment, a 220V standard three-slot electrical outlet is taken as an example for illustration, but is not limited thereto.

Except of that, the embodiment may add the power switch 22*a* to allow the users to control the electrical power by turning on or off the power switch 22*a*. Furthermore, the indicator 24*a* is applied to provide operating information of the USB jack assembly 16*a* to the users. For example, as the indicator 24*a* is emitting light, it represents that the USB jack assembly 16*a* is in function and is supplying electrical power to the portable electronic device connected with the USB jack assembly 16*a*; conversely, as the indicator 24*a* is not emitting light, it represents that the USB jack assembly 16*a* is out of function or in defect and is not supplying electrical power to the portable electronic device connected with the USB jack assembly 16*a*.

Figure 2:
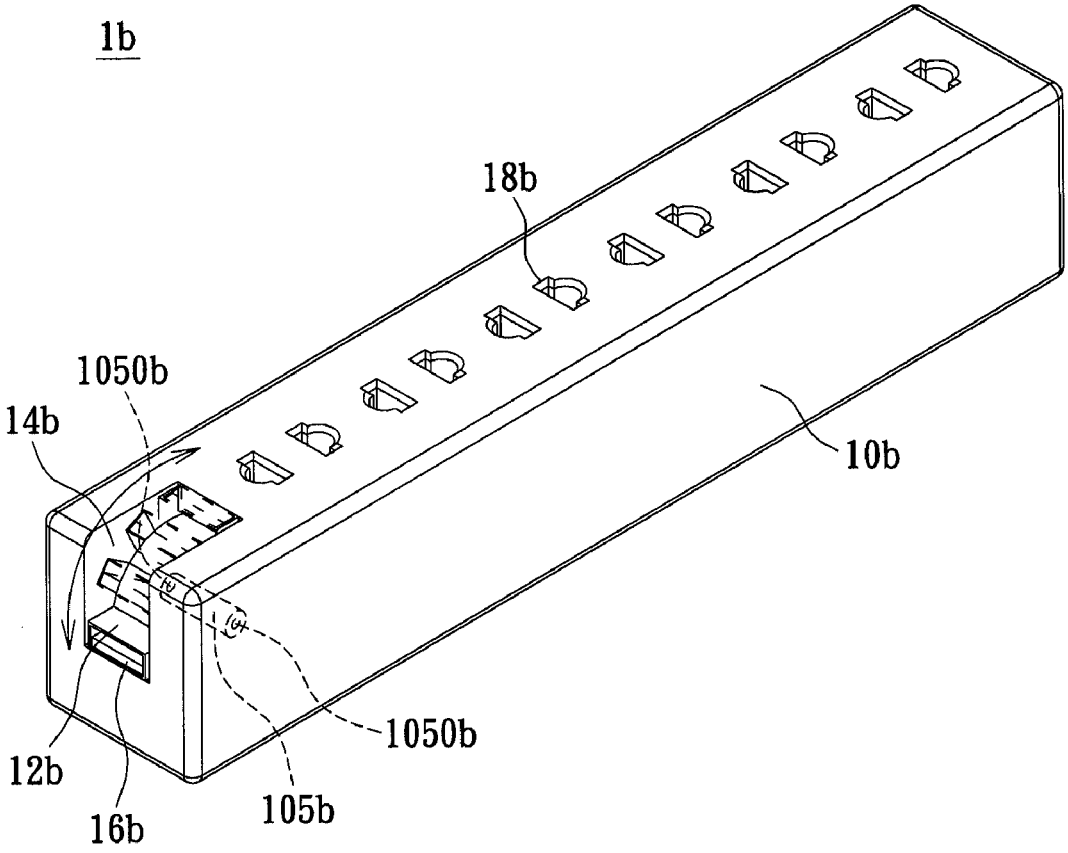
FIG. 2 illustrates an exploded diagram of a second embodiment of the electrical power receptacle with rotatable USB jacks according to the present invention.

Next please refer to FIG. 2 in conjunction with FIG. 1, in which an exploded diagram of a second embodiment of the electrical power receptacle with rotatable USB jacks according to the present invention is demonstrated. An electrical power receptacle with rotatable USB jacks 1*b* has identical elements and similar connecting relationship with respect to that of FIG. 1, yet the only structural difference is a design of a shaft section 105*b*, a rotating member 12*b*, and an accommodating section 14*b* configured with a main body 10*b*. The shaft section 105*b* is disposed on the peripheral regions of the main body 10*b*. The accommodating section 14*b* has changed it's shape and size with respect to the size and shape of the rotating member 12*b*. according to the structural design of the rotating member 12*b* and the accommodating section 14*b* configured on the main body 10*b*, the rotating member 12*b* is capable of rotating along a predetermined axis of the shaft section 105*b* around 90 degrees inside the accommodating section 14*b*, so that a USB jack assembly 16*b* configured on the rotating member 12*b* is taken along to rotate around 90 degree as well. The configuration position of the shaft section 105*b* in accordance with the embodiment is merely for illustration, but is not limited thereto. The USB jack assembly 16*b* electrically connects to a power source (not shown) thru two shaft contacts 1050*b*. Two-slot electrical outlets are taken for illustration in the embodiment, but the specifications and standards of the electrical outlet assemblies 18*b* are not limited thereto.

Figure 3:
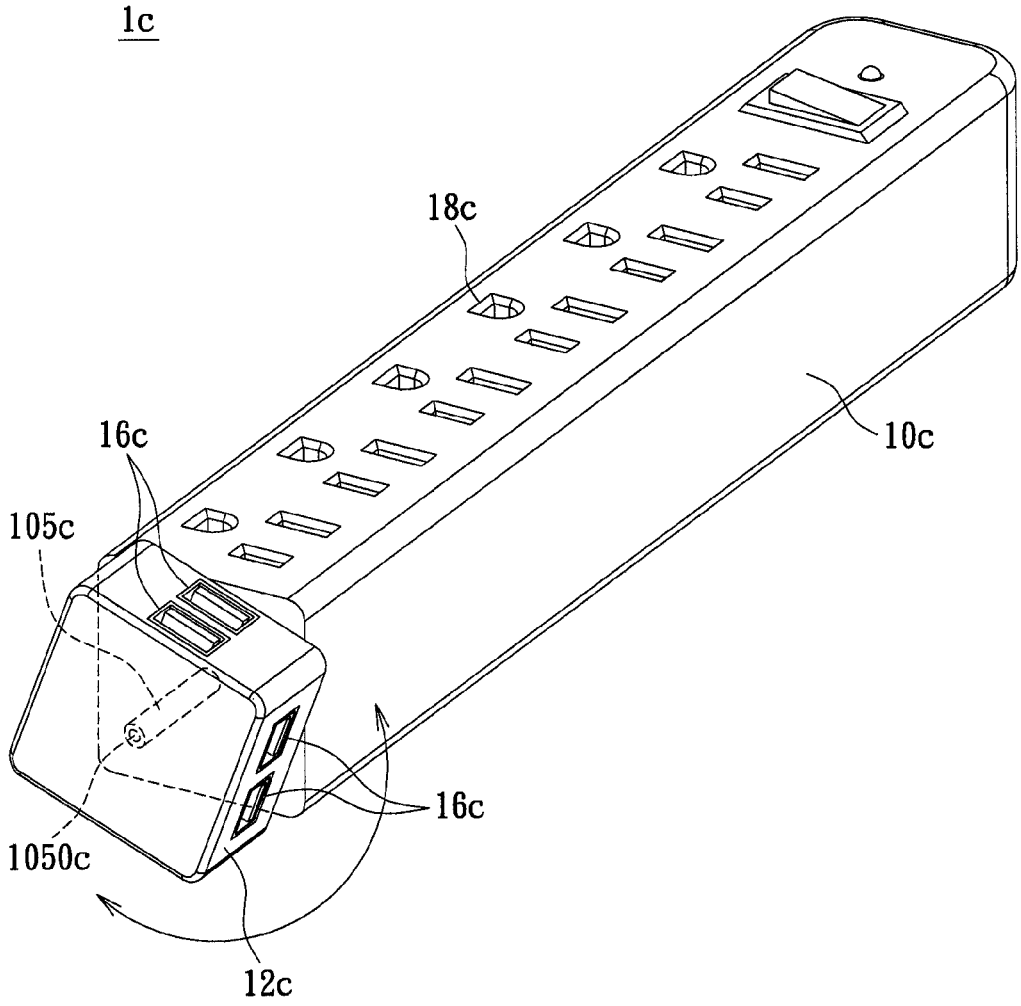
FIG. 3 illustrates an exploded diagram of a third embodiment of the electrical power receptacle with rotatable USB jacks according to the present invention.

Next please refer to FIG. 3, in which an exploded diagram of a third embodiment of the electrical power receptacle with rotatable USB jacks according to the present invention is demonstrated. An electrical power receptacle with rotatable USB jacks 1*c* has identical elements and similar connecting relationship with respect to that of FIG. 1, yet the only structural difference is a design of a shaft section 105*c* and a rotating member 12*c* configured with a main body 10*c*. The shaft section 105*c* is disposed on the front portion of the main body 10*c*, but is not limited thereto, for example, the shaft section 105*c* may disposed on the rear portion or middle portion of the main body 10*c*. As shown in FIG. 3, the shaft section 105*c* is conversely disposed on the main body 10*c*. The rotating member 12*c* coupled to the shaft section 105*c* is rotatable with respect to a predetermined axis of the shaft section 105*c* transversely outside of the main body. As such, the rotating member 12*c* of the embodiment may have a rotating space without restricted by the original structural design of the main body 10*c*. In other words, the rotating member 12*c* is capable of rotating along the predetermined axis of the shaft section 105*c* in any angle freely (360 degrees), so that USB jack assemblies 16*c* configured on the rotating member 12*c* is taken along to rotate in any angle as well. The USB jack assemblies 16*c* electrically connect to a power source thru a shaft contact 1050*c*. The configuration position of the shaft section 105*c* may convexly disposed not only on the front portion and the rear portion of the main body 10*c*, but also on the middle portion of the main body 10*c*. The quantity of the USB jack assemblies 16*c* and the configuration in series or in parallel order in accordance with the embodiment is merely for illustration, but it not limited thereto. Three-slot electrical outlets are taken for illustration in the embodiment, but the specifications and standards of the electrical outlet assemblies 18*c* are not limited thereto.

Figure 4:
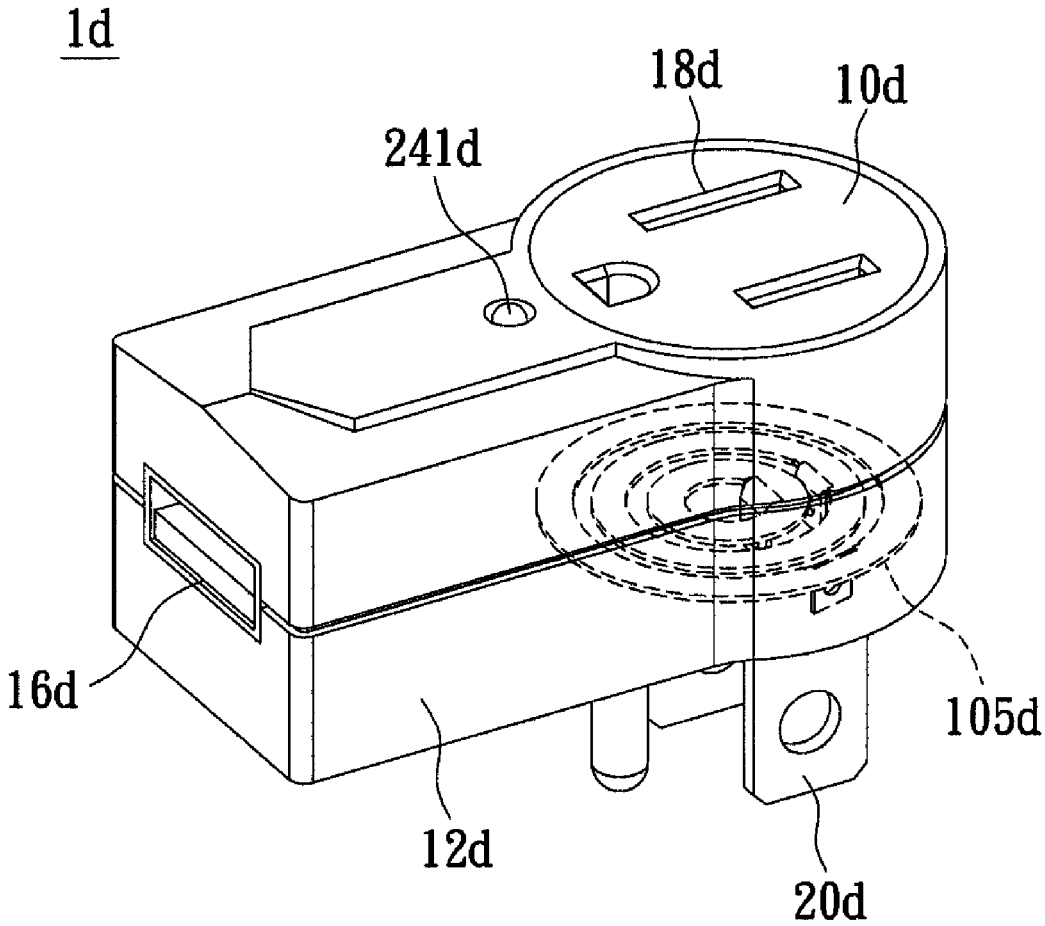
FIG. 4 illustrates an exploded diagram of a fourth embodiment of the electrical power receptacle with rotatable USB jacks according to the present invention.

Next please refer to FIG. 4, in which an exploded diagram of a fourth embodiment of the electrical power receptacle with rotatable USB jacks according to the present invention is demonstrated. An electrical power receptacle with rotatable USB jacks 1*d* has identical elements and similar connecting relationship with respect to that of FIG. 1, yet the only structural difference is a design of a shaft section 105*d* and a rotating member 12*d* configured with a main body 10*d*. An electrical outlet assembly 18*d* is disposed on a side of the main body 10*d* in accordance with the electrical power receptacle with rotatable USB jacks 1*d* and the rotating member 12*d* couples to the main body 10*d* so as to bring along a USB jack assembly 16*d* configured on the rotating member 12*d* to rotate in any angle out of the main body 10*d*. Nevertheless, according to different structural designs with respect to different requirements, the rotating member 12*d* may engage with the main body 10*d* into a functional unit as shown in the embodiment. Meanwhile, an electrical plug assembly 20*d* disposed on another side of the main body is rotatable along a predetermined axis of the main body 10*d* freely in any angle (360 degrees) individually inside the rotating member 12*d*. As such, the electrical plug assembly 20*d* may individually operate without influence by the operations of the USB jack assembly 16*d* configured on the rotating member 12*d* and the electrical outlet assembly 18*d* configured on the main body 10*d*. The predetermined axis of the main body 10*d* is the center axis of the shaft section 105*d*. The rotating member 12*d* of the embodiment may have a rotating space without restricted by the original structural design of the main body 10*d*. A LED indicator 241 functions by illuminating or not to represent the USB jack assembly 16*d* is in a conduction mode or in a cutoff model.

Figure 5:
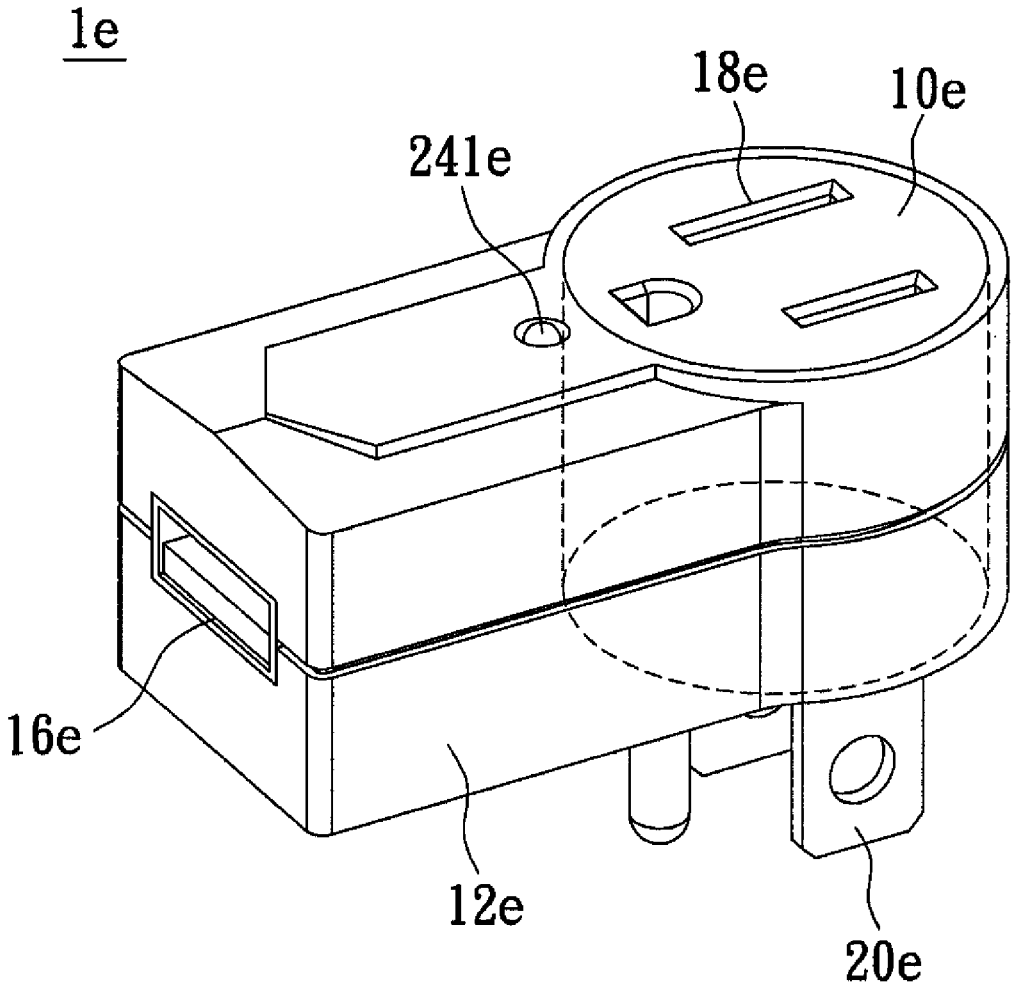
FIG. 5 illustrates an exploded diagram of a fifth embodiment of the electrical power receptacle with rotatable USB jacks according to the present invention.

Please refer to FIG. 5, in which an exploded diagram of a fifth embodiment of the electrical power receptacle with rotatable USB jacks according to the present invention is demonstrated. An electrical power receptacle with rotatable USB jacks 1*e* has identical elements and similar connecting relationship with respect to that of FIG. 1, yet the only structural difference is a design of a rotating member 12*e* configured with a main body 10*e*. An electrical outlet assembly 18*e* is disposed on a side of the main body in accordance with the electrical power receptacle with rotatable USB jacks 1*e* and an electrical plug assembly 20*e* is disposed on the other side thereof. The electrical plug assembly 20*e* may have two or three conducting prongs. The shaft section (not shown) is disposed between the main body 10*e* and the rotating member 12*e*, so that the rotating member 12*e* is configured to surround the main body 10*e* and is capable of rotating along a predetermined axis of the main body 10*e* in any angle transversely (360 degrees). Consequently, a USB jack assembly 16*e* disposed on the rotating member 12*e* is rotatable with respect to the predetermined axis of the main body 10*e* in any angle. As such, the rotating member 12*e* of the embodiment is not restricted in rotating space by the original structural design of the main body 10*e*. A LED indicator 241*e* functions by illuminating or not to represent the USB jack assembly 16*e* is in a conduction mode or in a cutoff model.

Figure 6:
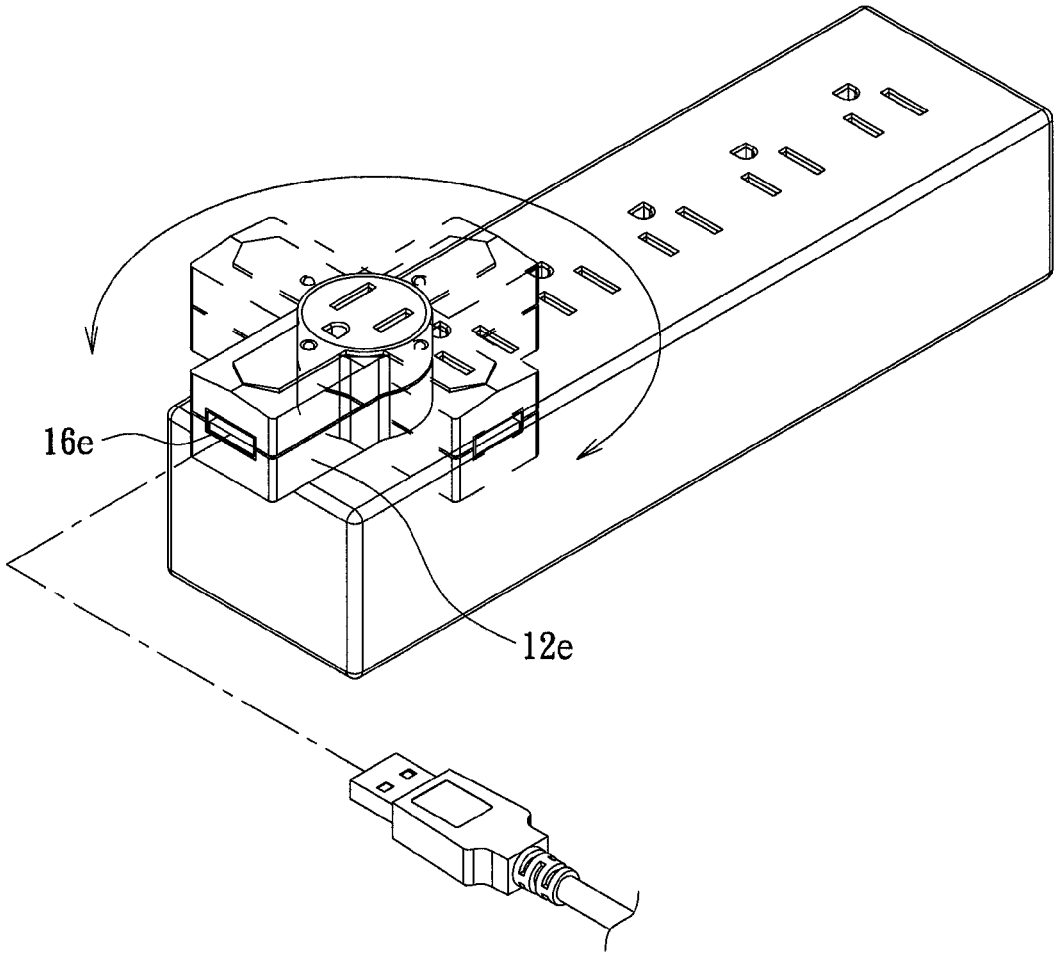
FIG. 6 illustrates a diagram of the fifth embodiment of the electrical power receptacle with rotatable USB jacks according to the present invention in use.

Finally please refer to FIG. 6 in conjunction with FIG. 5, in which a diagram of the fifth embodiment of the electrical power receptacle with rotatable USB jacks according to the present invention in use is demonstrated. As the electrical plug assembly 20*e* is fixed in application, the USB jack assembly 16*e* may connect to a USB connector and rotatable along with the rotating member 12*e*.

In the aspects of the aforementioned embodiments, the technical characteristics of the electrical power receptacle with rotatable USB jacks according to the present invention are capable of changing the directions of the USB jacks with respect to the variations in environment or the requirements in application, thereby increasing the convenience of use. As such, the electrical power receptacle with rotatable USB jacks is not limited by the USB connection direction with regards to the conventional fixed type USB jacks. Moreover, the USB jacks configured with the electrical power receptacle provide a simple and easy electrical connecting method for a variety of electronic devices adapted for USB interface connection. The shaft section of the electrical power receptacle with rotatable USB jacks may be of a cylindrical shape, a ring shape, or a disk shape.

The aforementioned descriptions represent merely the preferred embodiment of the present invention, without any intention to limit the scope of the present invention thereto. Various equivalent changes, alterations, or modifications based on the claims of present invention are all consequently viewed as being embraced by the scope of the present invention.

What is claimed is:

1. An electrical power receptacle with rotatable USB jacks, comprising:

a main body, including at least a shaft section;

at least an electrical outlet assembly, being disposed on the main body;

a rotating member, being mating engagement with the shaft section and rotatable with respect to a predetermined axis of the shaft section; and at least a USB electrical jack assembly, being disposed on the rotating member and rotatable with respect to a rotational movement of the rotating member.

2. The electrical power receptacle with rotatable USB jacks according to claim 1, wherein the main body further includes:

a first housing member; and a second housing member, being coupled to the first housing member to form the main body.

3. The electrical power receptacle with rotatable USB jacks according to claim 1, wherein the main body further includes an accommodating section and the shaft section is disposed inside the accommodating section for allowing the rotating member being rotating with respect to the predetermined axis of the shaft member inside the accommodating section.

4. The electrical power receptacle with rotatable USB jacks according to claim 1, further including an electrical plug assembly, being disposed on the main body, having two or three conducting prongs.

5. The electrical power receptacle with rotatable USB jacks according to claim 1, further including a power switch, being disposed on the main body, for controlling the electrical power supply.

6. The electrical power receptacle with rotatable USB jacks according to claim 1, further including an indicator, being disposed on the main body, for displaying the electrical power receptacle with rotatable USB jacks either in a conduction mode or in a cutoff mode.

7. The electrical power receptacle with rotatable USB jacks according to claim 6, wherein the indicator functions as a LED indicator.

8. The electrical power receptacle with rotatable USB jacks according to claim 1, wherein the shaft section convexly disposes out of the main body for allowing the rotating member to rotate with respect to the predetermined axis of the shaft section in any angle, and the shaft section is of a cylindrical shape, a ring shape, or a disk shape.

9. The electrical power receptacle with rotatable USB jacks according to claim 1, wherein the USB jack assembly electrically connects to the electrical outlet assembly by means of a plurality of shaft contacts of the shaft section.

10. The electrical power receptacle with rotatable USB jacks according to claim 1, wherein the electrical outlet assembly is either one or a combination of a three-slot or two-slot electrical outlets.

* * * * *